US005632174A

United States Patent [19]

Hunter

[11] Patent Number: 5,632,174

[45] Date of Patent: May 27, 1997

[54] METAL BENDING MACHINE

[76] Inventor: Dennis Hunter, 944 W. 53rd St. N., Wichita, Kans. 67204

[21] Appl. No.: 511,545

[22] Filed: Aug. 4, 1995

[51] Int. Cl.[6] ..... B21D 7/08

[52] U.S. Cl. ..... 72/129; 72/170; 72/173; 72/248

[58] Field of Search ..... 72/170, 173, 175, 72/168, 129, 248, 245

[56] References Cited

U.S. PATENT DOCUMENTS

| | | | |
|---|---|---|---|
| 173,689 | 2/1876 | Teal | 72/175 |
| 629,496 | 7/1899 | Diescher | 72/173 |
| 1,338,946 | 5/1920 | Meyers | 72/175 |
| 3,023,800 | 3/1962 | White | 72/173 |
| 4,132,099 | 1/1979 | Elsener | 72/175 |
| 4,202,197 | 5/1980 | Vydrin | 72/245 |
| 5,115,658 | 5/1992 | Kirchhoff | 72/175 |

FOREIGN PATENT DOCUMENTS

| | | | |
|---|---|---|---|
| 1612 | of 1855 | United Kingdom | 72/170 |
| 1225 | of 1883 | United Kingdom | 72/173 |
| 5121 | of 1891 | United Kingdom | 72/170 |
| 4551 | of 1900 | United Kingdom | 72/173 |

*Primary Examiner*—Daniel C. Crane
*Attorney, Agent, or Firm*—Kenneth H. Jack

[57] ABSTRACT

A metal bending machine comprising a lower pinchroller composed of modular interchangeable segments, and upper pinchroller composed of modular interchangeable segments, and a radius roller composed of modular interchangeable segments, the lower pinchroller being fixedly and rotatably mounted upon a pinchroller table, the upper pinchroller being rotatably and vertically adjustably mounted in alignment with and above the lower pinchroller, and the radius roller being rotatably and vertically adjustably mounted upon the pinchroller table behind the upper and lower pinch rollers, the upper and lower pinchrollers being counter-rotated with respect to each other by a rotating means, the segments of the upper and lower pinchrollers and the radius roller having annular channels therearound closely fitted to the cross-sectional profile of a workpiece to be bent by the metal bending machine, the metal workpiece being driven into and through the pinch point formed by the upper and lower pinchrollers, and into contact with an over the radius roller, inducing a progressive bend upon the metal workpiece as the metal workpiece is progressively driven through the pinch point.

9 Claims, 9 Drawing Sheets

FIG. 8
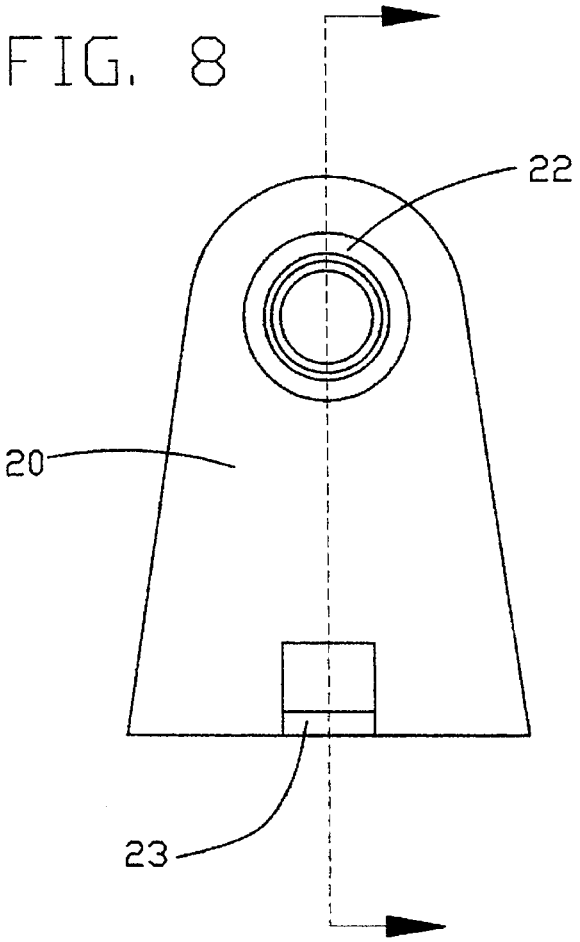
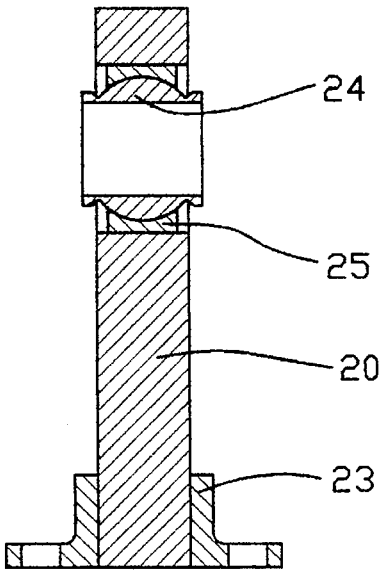
FIG. 9

METAL BENDING MACHINE

FIELD OF THE INVENTION

The present invention relates to an apparatus for bending sheet metal, tubular metal of various geometric cross-sections and sizes, and for bending angle iron, channel iron, I-beams and the like. More particularly, this invention relates to bending of such metal objects by means of driving the metal workpiece through a pinchroller press and into contact with and over a radius roller which induces a bend in the metal. More particularly, this invention relates to an improvement wherein the pinchrollers and the radius roller are divided into modular and interchangeable segments, the segments having annular channels therearound, the channels being closely fitted for receiving various and differing gauges and shapes of tubular metal, angle iron, channel iron, I-beams and the like.

BACKGROUND OF THE INVENTION

Metal bending machines comprising a lower pinchroller, an upper pinchroller and a radius roller are known. In such machines, the lower pinchroller is rotatably mounted upon a rigid structure or base, and a means of rotating the lower pinchroller such as a hydraulic motor or a chain drive is applied to one end of the pinchroller. In such machines, the upper pinchroller is suspended above the lower pinchroller in alignment therewith by a mechanism which provides for variable vertical positioning of the upper pinchroller with respect to the lower pinchroller, and which allows rotation of the upper pinchroller. A rotating means such as a hydraulic motor or a chain drive is applied to an end of the upper pinchroller. In operation, the rotating means of the upper and lower pinchrollers counter-rotate. When a metal work piece is inserted into the pinch point between such upper and lower pinchrollers, along a line substantially tangent to the pinchrollers, the counter-rotation pulls the metal workpiece into the pinch point and then drives the workpiece outward from the pinch point on the other side of the pinchrollers along the tangent line.

In order for pinchrollers configured as described above to perform the function of bending a metal workpiece, a radius roller is typically mounted in alignment with the pinchrollers, and positioned so that a metal workpiece being drawn through the pinch point of the pinchrollers comes into contact with the exterior radial surface of the radius roller at a point above the axis of the radius roller. Upon such contact, the metal workpiece is deflected upward. The upward deflection induced by the radius roller causes the metal workpiece to bend at the pinch point. Continued progression of the metal workpiece driven through the pinch point of the pinchrollers and continued upward deflection induced by the radius roller results in a constant bend along the length of the workpiece.

A typical application of metal bending through use of pinchrollers and a radius roller configured as described above is the formation of a tubular pipe section from flat sheet metal. A piece of rectangular sheet metal may be driven through the pinch point and deflected upward over the radius roller until the metal curls back upon itself in a circle. Upon removal of the curled metal workpiece from the machine, the ends of the workpiece may be welded to each other to form a cylindrical pipe section.

Pinch rolling metal bending machines as described above typically are useful only for bending sheet metal and substantially flat metal bars. Tubular metal and metal configured as an angle iron, a channel iron, or an I-beam which is driven through pinchrollers and over a radius roller as configured above are subject to crushing deformation and spiral out of plane bending. To eliminate the problems of crushing deformation and spiral bending, pinch rolling metal bending machines are known to be "customized" to induce bends upon metal workpieces having various cross-sectional shapes. For example, a pinch rolling metal bender designed to accommodate metal pipes having a circular cross-section would have a lower pinchroller with an annular semi-circular channel closely fitted to the exterior radial surface of the pipe. The upper pinchroller and the radius roller would have a similar annular channel. Each of the three channels are aligned within a common plane. Where the pinchrollers and the radius roller have such specially fitted annular channels, the pinch point matches the cross-sectional shape of the workpiece preventing the compressive force of the pinchrollers from crushing or distorting the workpiece. The workpiece contacts the radius roller within a fitted annular channel assuring that the bend lies within a single plane, rather drifting laterally, causing a spiral bend.

A metal working machine shop may have several pinch rolling metal bending machines in order to bend sheet metal, channel iron, I-beams, and tubular metal of various shapes. Utilizing several machines to perform pinch rolling metal bending upon metal workpieces of varying shapes is uneconomical in terms of money, manufacturing space, and time spent moving from machine to machine. The present invention eliminates these disadvantages by providing a single pinch rolling metal bending machine which may be interchangeably configured to accommodate at one time several types of metal workpieces, including sheet metal, angle iron, channel iron, I-beams, and tubular metal.

OBJECTS OF THE INVENTION

The principal object of the present invention is to provide a pinch rolling metal bending machine which can induce bends upon metal workpieces of varying shapes including sheet metal, tubular metal of various cross-sectional shapes, channel iron, angle iron, I-beams, and the like.

Another object of the present invention is to provide a pinch rolling metal bending machine having interchangeable and modular pinchroller segments, such segments having annular channels therearound closely fitted for receiving and inducing bends upon a metal workpiece.

Another object of the present invention is to provide a pinch rolling metal bending machine having a hydraulic drive system and a hydraulic pinchroller positioning system.

Another object of the present invention is to provide a pinchrolling metal bending machine having an upper pinchroller which is multiply adjustable by means of hydraulic rams and screw adjustments.

Another object of the present invention is to provide a pinch rolling metal bending machine having a support structure and housing which further incorporates a metal shearing and bending press.

Other and further important objects of this invention will be apparent from the disclosures, from the specification, and from the accompanying drawings.

SUMMARY OF THE INVENTION

The above objects and others which will become apparent hereinafter are attained, in accordance with the present invention by providing a segmented lower pinchroller fixedly and rotatably mounted above a planer surface such as a table top or a work bench top; by providing a segmented upper pinchroller rotatably mounted above the lower pinchroller, and in alignment therewith; by providing a mechanism whereby the upper pinchroller may alternately move between a first position in which it is in close proximity with the lower pinchroller and second positions in which the upper pinchroller is raised above the lower pinchroller; by providing a means of counter-rotating the upper pinchroller and the lower pinchroller with respect to each other; and by providing a segmented radius roller rotatably mounted in alignment with and in close proximity to the upper and lower pinchrollers, the radius roller being positioned so that a metal workpiece being driven through the pinch point of the pinchrollers comes into contact with the radius roller at a point above its axial line.

By reference to the accompanying drawings and the detailed description of drawings below, a more detailed and particular understanding of the instant invention may be obtained. The drawings and detailed description are exemplary and are not intended as limiting the scope of the invention. Other configurations and equivalents within the scope of the invention will readily become apparent to those skilled in the art.

BRIEF DESCRIPTION OF THE DRAWINGS

FIG. 8 is a side view of a pinchroller bearing support.

FIG. 9 is a sectional view of a pinchroller bearing support.

DETAILED DESCRIPTION OF THE DRAWINGS

Figure 1:
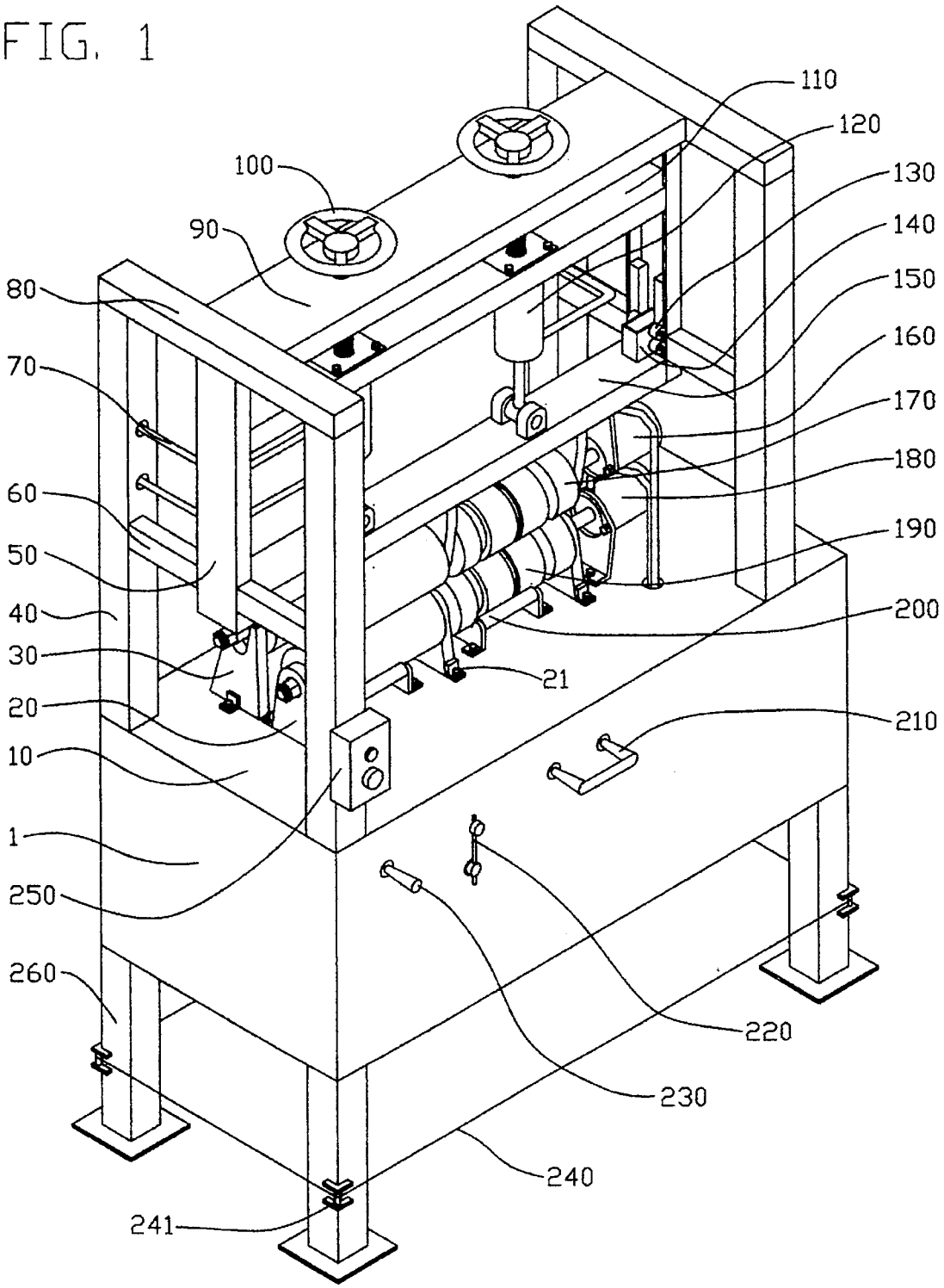
FIG. 1 is a perspective view from above of the front of the metal bending machine.
Figure 3:
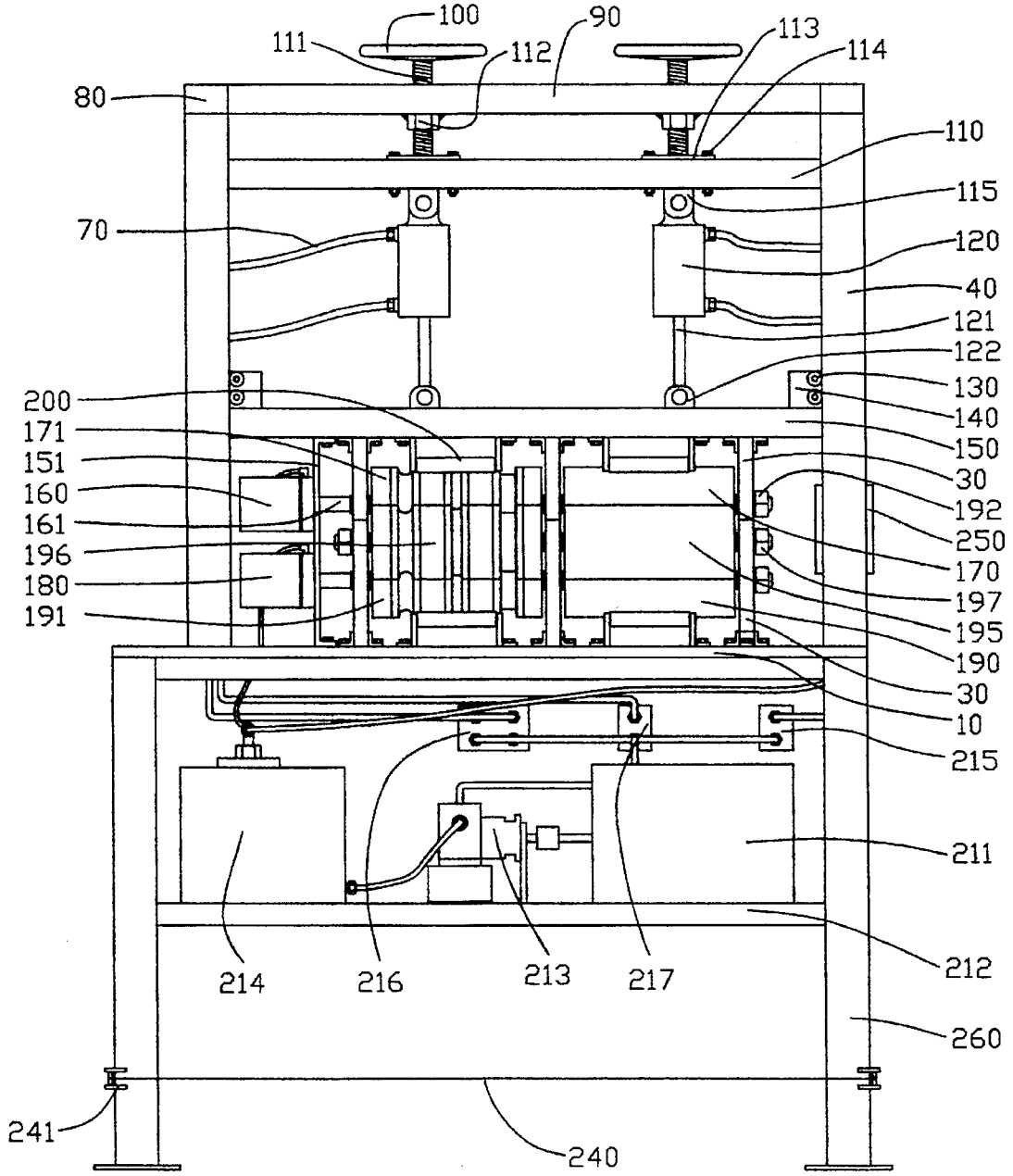
FIG. 3 is a view of the back of the metal bending machine.

Referring to FIG. 1, the support structure of the metal bending machine comprises a hydraulic drive housing 1 having a pinchroller table 10 and having two sidewalls, a front wall, and, referring to the reverse view of FIG. 3, a floor 212. Referring to FIG. 1, the hydraulic housing 1 has four support legs 260, one at each of its four corners, and four support columns 40 extending upward from each of the corners of the pinchroller table 10. The support columns 40 are supported and rigidly connected to each other by support column braces 80, each extending from a rear support column to a front support column. A fixed crossbeam 90 further supports the support columns 40 and support column braces 80, spanning between the support column braces 80. Extending vertically downward from each support column brace 80 is a vertical adjustment track 50. The lower end of each vertical adjustment track 50 is supported and fixed in place by horizontal adjustment track braces 60 extending horizontally outward from the sides of the vertical adjustment tracks 50 to the sides of the support columns 40. The columns, beams and braces described above preferably are composed of tubular steel, the joints of which are permanently fused by means of oxyacetylene or electrical arc welding.

Figure 4:
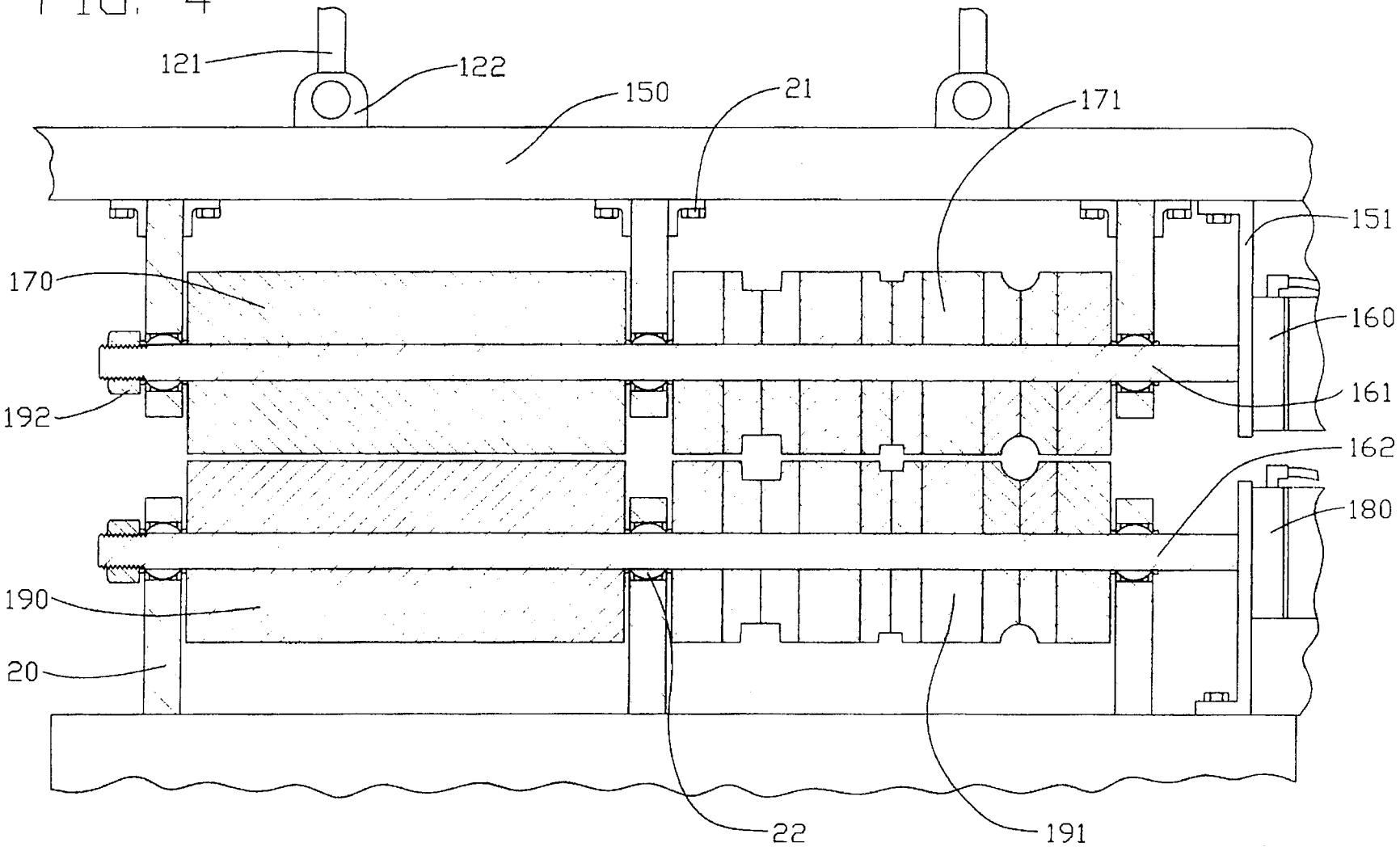
FIG. 4 is a sectional view depicting the upper and lower pinchrollers and upper and lower pinchroller bearing supports, the sectional plane passing through the axes of rotation of the pinchrollers.

The lower pinchrollers 190 are fixedly and rotatably mounted upon the pinchroller table 10 by means of three pinchroller bearing supports 20, the pinchroller bearing supports being fixedly attached to the pinchroller table by means of brackets and bolts 21. Referring to FIG. 4, the lower pinchrollers 190 rest upon and rotate about a lower pinchroller drive shaft 162 which passes axially through the lower pinchrollers 190 and through self-aligning spherical bearings 22 mounted within the lower pinchroller bearing supports 20.

Figure 2:
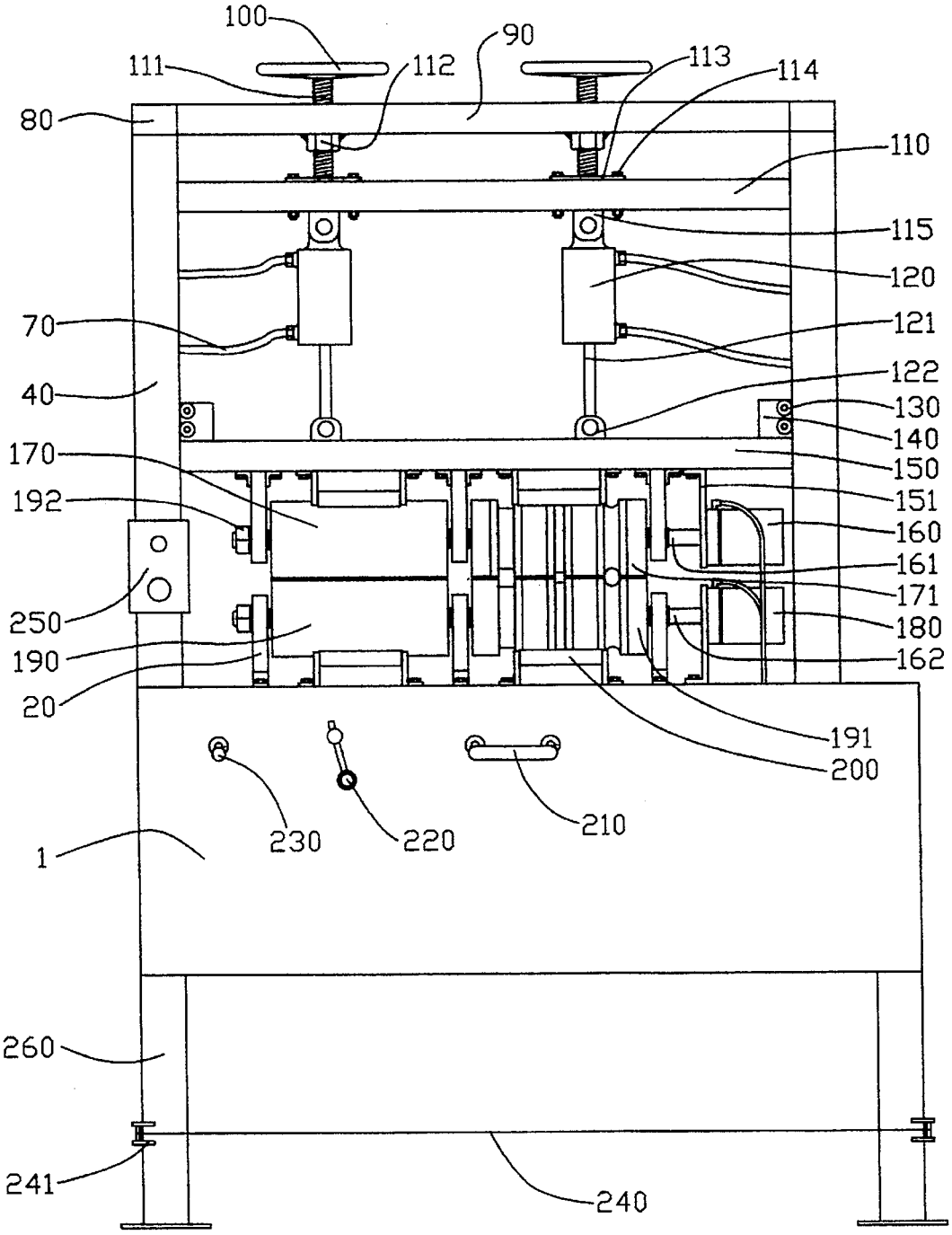
FIG. 2 is a frontal view of the metal bending machine.

Referring again to FIG. 1, the upper pinchrollers 170 are suspended above the lower pinchrollers 190 by means of pinchroller bearing supports 20 extending downward from and being fixedly attached to the lower surface of a pinchroller support beam 150 which is pivotally attached to a pair of pinchroller hydraulic rams 120, the rams being pivotally attached to a hydraulic ram support beam 110, said beam being vertically adjustably attached to the fixed crossbeam 90 by means, referring to FIG. 2, of ram adjustment screws 111.

Referring simultaneously to FIGS. 2, 8 and 9, each of the six self-aligning spherical bearings 22 comprises a spherical bushing 25 and a spherical bearing 24. The self-aligning spherical bearings 22 serve the function of eliminating twisting forces exerted by the upper and lower pinchroller drive shafts 161 and 162 upon the pinchroller bearing supports 20 when downward compressive forces are applied to the pinchrollers by the pinchroller hydraulic rams 120. Such twisting forces arise through deflection and bending of the upper and lower pinchrollers 170 and 190, and deflection of the upper and lower pinchroller drive shafts 161 and 162 upon application of compressive force thereto. If tubular bushings are used as the bearings instead of self-aligning spherical bearings, such twisting forces would cause premature wear and breakage of the bearings. The axial length of the self-aligning spherical bearings is slightly longer than the width of the bearing supports 20 preventing frictional contact between the pinchrollers and the bearing supports.

Figure 5:
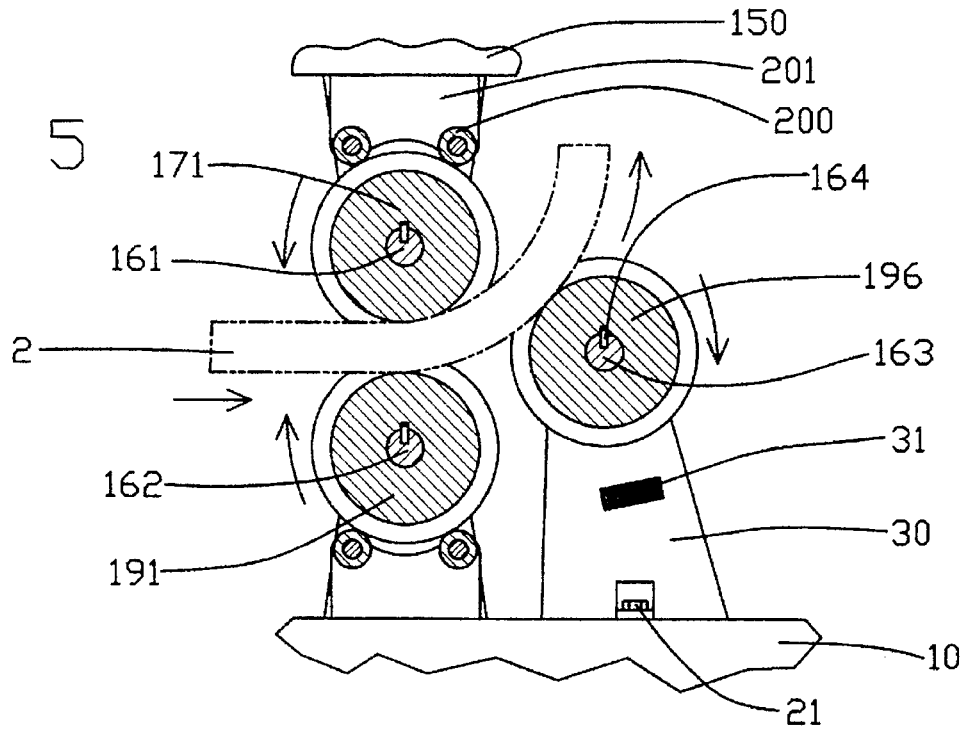
FIG. 5 is a sectional view of the upper and lower pinchrollers and radius roller showing the action of the machine upon a tubular metal workpiece, the sectional plane passing through the pinchrollers and the radius roller perpendicular to their axes of rotation and within a pipe bending channel.

Referring simultaneously to FIGS. 2 and 5, deflection of the pinchrollers 170 and 190 is further reduced by pinchroller deflection bearings 200 which are rotatably mounted upon the pinchroller table 10 and upon the lower surface of the pinchroller support beam 150 by means of deflection bearing supports 201. The pinchroller deflection bearings 200 are mounted and aligned causing the exterior radial surfaces of the deflection bearings to come into contact and roll along the exterior radial surfaces of the pinchrollers as the pinchrollers turn. The pinchroller deflection bearings so mounted reduce deflection of the pinchrollers resulting from compression by the pinchroller hydraulic rams 120.

Figure 12:
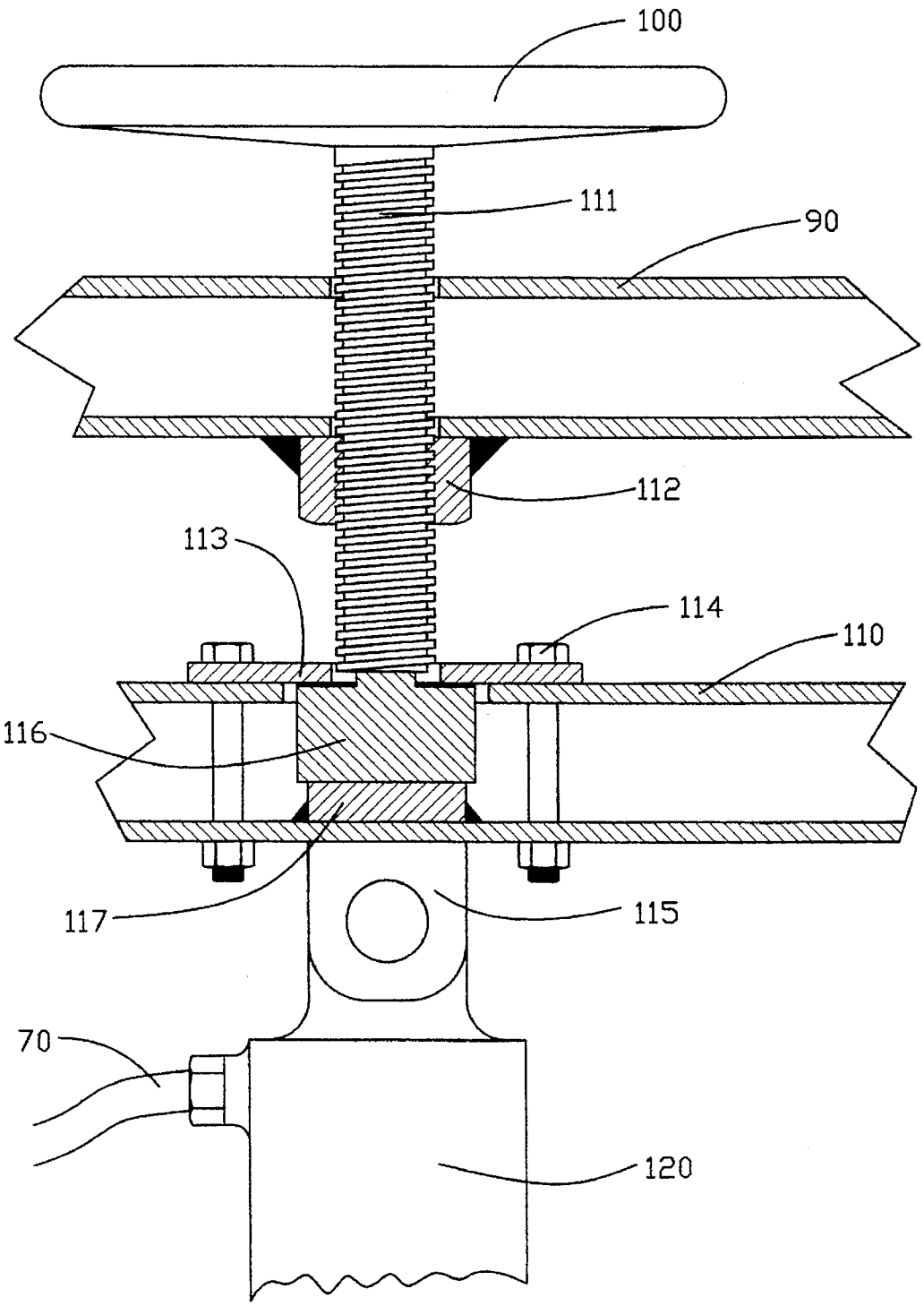
FIG. 12 is a sectional view of the hydraulic ram vertical positioning assembly.

Referring to FIG. 12, each ram adjustment screw 111 passes through an aperture in the fixed crossbeam 90, the threads of each ram adjustment screw engaging with and being held by the threads of ram adjustment nuts 112, which are fixedly attached to the crossbeam 90 over the apertures. Alternate clockwise and counter-clockwise rotation of a ram adjustment screw 111 by means of turning a vertical adjustment wheel 100 alternately raises and lowers the foot 116 of the ram adjustment screw 111. Clockwise rotation of the vertical adjustment wheel 100 causes the foot 116 to travel downward, and to press downward upon a compression plate 117, which in turn causes the hydraulic ram support beam 110 to travel downward. Downward motion of the hydraulic ram support beam 110 causes the ramhead pin and clevice joint 115 and the pinchroller hydraulic ram 120 to travel downward. Counterclockwise rotation of a vertical adjustment wheel 100 causes all of the above movable components to travel upwards by means of force applied by the foot 116 to a retainer plate 113, the retainer plate being fixedly attached to the hydraulic ram support beam 110 by means of retainer plate bolts 114.

Figure 7:
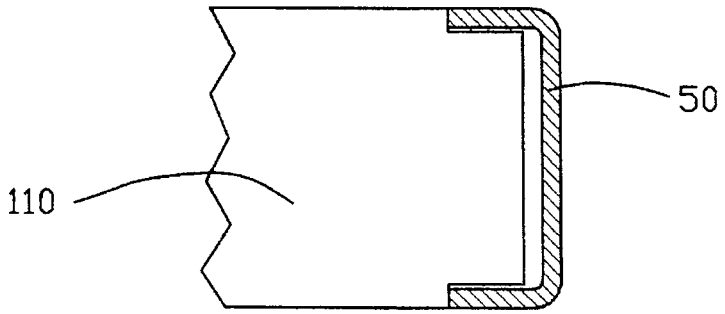
FIG. 7 is a sectional view of the sliding connection of the end of the crossbeam which supports the pinchroller hydraulic rams.
Figure 10:
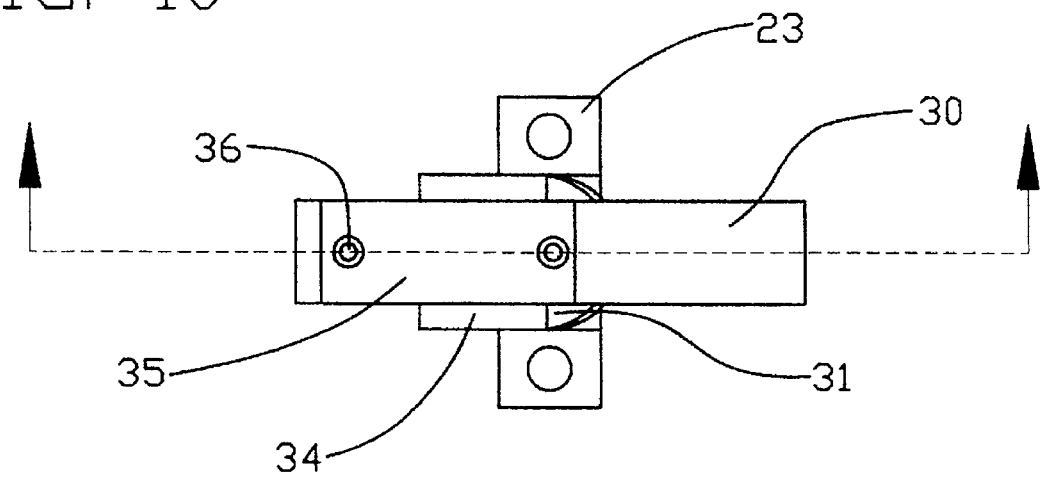
FIG. 10 is a view from above of a radius roller bearing support.

Referring simultaneously to FIGS. 1 and 7, upon rotation of the vertical adjustment wheels 100, the hydraulic ram support beam 110 will travel upward or downward, the ends of the hydraulic ram support beam 110 moving slidably within the concave inner surface of the vertical adjustment tracks 50. Thus, the vertical position of the two pinchroller hydraulic rams 120 may be independently adjusted by alternately manipulating the vertical adjustment wheels 100.

Referring to FIG. 12, the head of each pinchroller hydraulic ram 120 is pivotally attached to the hydraulic ram support beam 110 by means of a ram head pin and clevice joint 115. Referring to FIG. 2, the shaft 121 of each pinchroller hydraulic ram 120 is similarly pivotally attached to the pinchroller support beam 150 by means of a ram shaft pin and clevice joint 122.

Figure 6:
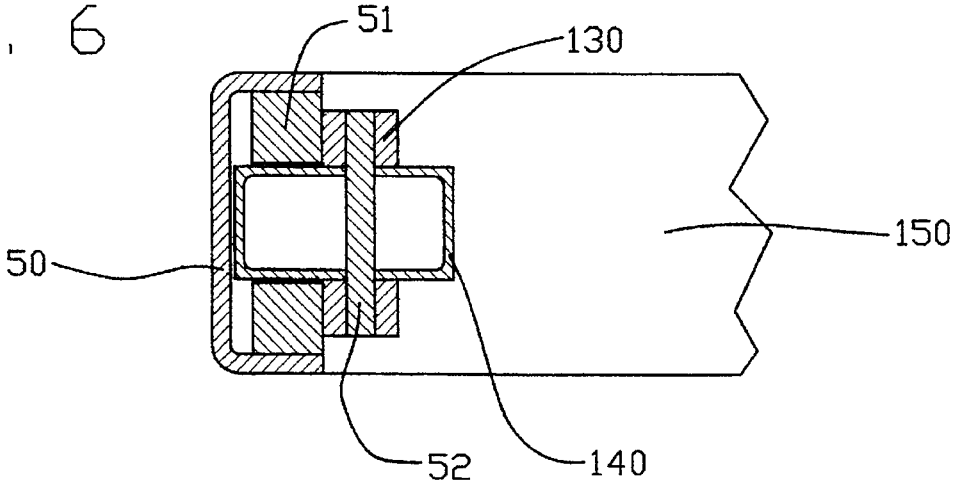
FIG. 6 is a sectional view of the roller bearings which facilitate vertical positioning of the crossbeam which supports the upper pinchroller.

Referring simultaneously to FIGS. 1 and 6, the ends of the pinchroller support beam 150 may roll vertically upward and downward over the vertical adjustment tracks 50 by means of roller bearings 130, each having a roller bearing axle 52 passing through and being supported by a roller bearing support 140, each roller bearing support 140 being fixedly attached to the upper surface of the pinchroller support beam 150. The roller bearings 130 press against and roll upward or downward over roller surface blocks 51 which are fixedly attached to the interior sidewall surfaces of the vertical adjustment tracks 50.

The independent rolling contact between the ends of the pinchroller support beam 150 upon the roller surface blocks 51 of the vertical adjustment tracks 50 allows the elevation and angle of the pinchroller support beam 150 to be multiply adjustable by manipulating the vertical adjustment wheels 100 or by actuating the pinchroller hydraulic rams 120, or any combination thereof.

Referring to FIG. 4, the upper pinchrollers 170 are suspended from the pinchroller support beam 150 by means of an upper pinchroller drive shaft 161 passing axially through the upper pinchrollers 170 and through pinchroller bearing supports 20 which are fixedly attached to the pinchroller support beam 150 by means of brackets and bolts 21. As with the pinchroller support beam 150, the elevation and angle of the upper pinchrollers 170 with respect to the lower pinchrollers 190 are multiply adjustable by means of manipulating the vertical adjustment wheels 100 or by actuating the pinchroller hydraulic rams 120, or any combination thereof. As with the lower pinchrollers, the bearings of the upper pinchrollers are self-aligning spherical bearings.

Figure 11:
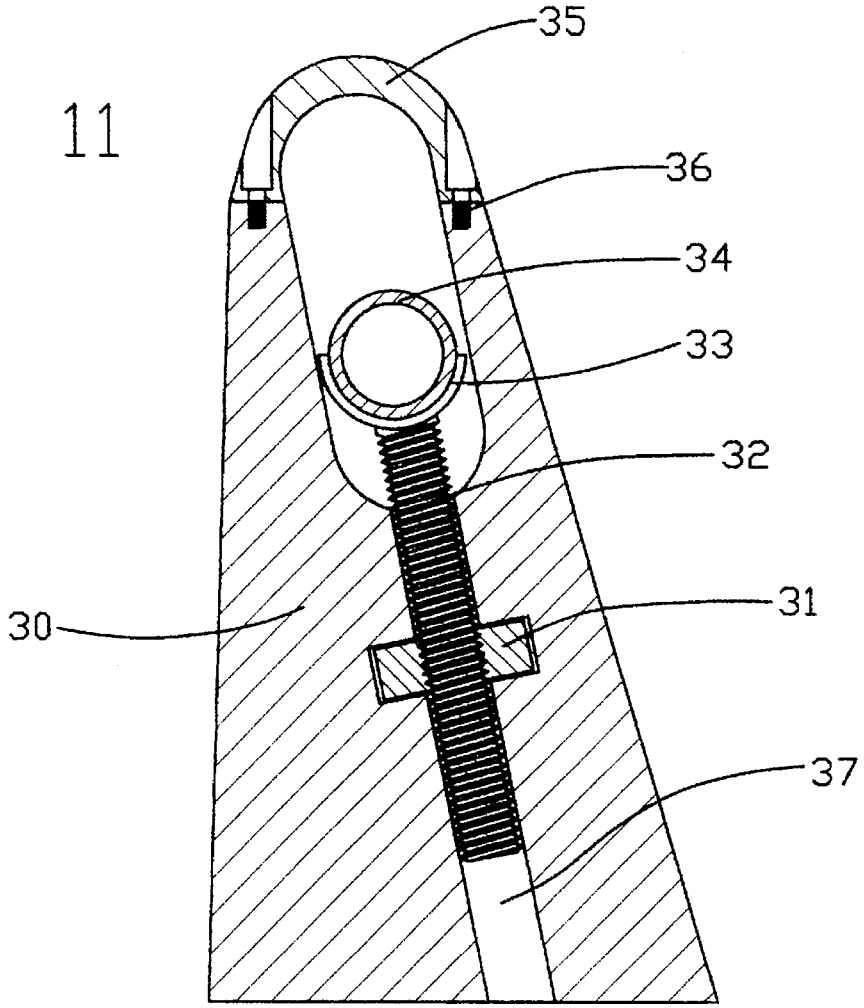
FIG. 11 is a side sectional view of a radius roller bearing support.

Referring to FIG. 3, radius rollers 195 are rotatably mounted immediately behind the upper and lower pinchrollers 170 and 190 by means of radius roller bearing supports 30 through which, referring to FIG. 5, a radius roller axle 163 passes; the radius roller axle 163 also passing axially through the radius rollers 195. Referring simultaneously to FIG. 3 and FIG. 11, the radius roller bearing supports 30 provide for vertical and horizontal positioning of the radius rollers 195 with respect to the pinch point of the upper and lower pinchrollers 170 and 190 by means of radius roller adjustment screws 32, said screws being rotatably and slidably mounted within adjustment screw channels 37. The radius roller adjustment screws 32 pass through thumb wheels 31 having threads closely fitted to the threads of the adjustment screws 32. The exterior radial surfaces of the thumb wheels 31 protrude from the sides of the radius roller bearings supports 30, allowing the thumb wheel 31 to be manually rotated; such rotation causing the radius roller adjustment screw 32 to travel upward or downward within the adjustment screw channels 37. Fixedly attached to the upper end of each radius roller adjustment screw 32 is a semi-circular bushing cradle 33, which is closely fitted to retain a radius roller bushing 34. Each of the radius roller bushings 34 are slightly longer than the width of a radius roller bearing support 30 preventing the ends of radius roller segments from coming into frictional contact with the sidewalls of the radius roller bearing supports 30. Such supports are fixedly attached to the pinchroller table 10 by bearing support brackets 23. Referring simultaneously to FIGS. 5 and 11, a radius roller axle 163 passes axially through the radius roller 195 and through the radius roller bushings 34.

By manually manipulating the thumb wheels 31 which are mounted within the three radius roller bearing supports 30, the angle of the axial line of the radius rollers 195 with respect to the axial lines of the upper and lower pinch rollers 170 and 190 may be adjusted. Such manipulation of the thumb wheels also may adjust the height of the upper surface of the radius rollers 195 with respect to the pinch point of the upper and lower pinchrollers 170 and 190. Such manipulation of thumb wheels also serves to adjust the horizontal distance of the radius rollers 195 from the upper and lower pinchrollers 170 and 190. In operation, the axial line of the radius rollers 195 is adjusted so that it is parallel with the axial lines of the upper and lower pinch rollers 170 and 190. In operation, the greater the differential in height between the upper surface of the radius rollers 195 above the pinch point of the upper and lower pinch rollers 170 and 190, the greater the bending effect induced upon a metal workpiece being driven through the pinch point.

Referring to FIG. 1, the hydraulic system which drives the hydraulic motors and the pinchroller hydraulic rams is contained within the hydraulic drive housing 1. Referring to FIG. 3, an electric motor 211, preferably single phase and 220 volts, is mounted upon the floor 212 of the hydraulic drive housing. Referring to FIG. 1, an electric motor switch box 250 activates and deactivates the electric motor 211. Referring again to FIG. 3, the electric motor drives a hydraulic pump 213 which draws hydraulic oil from a hydraulic oil reservoir 214. Hydraulic oil drawn from the reservoir 214 is driven by the hydraulic pump 213 through a series of hydraulic control valves; the valves being a roller speed adjustment valve 215, dual pinchroller ram valves 216, and a hydraulic pressure divider valve 217. Hydraulic lines 70 extend from the hydraulic control valves providing actuating force and control of the pinchroller hydraulic rams 120, and control of the upper and lower hydraulic motors 160 and 180. Referring simultaneously to FIG. 1 and FIG.

3, the roller speed adjustment lever 230 controls the roller speed adjustment valve 215, the pinchroller/hydraulic ram pressure divider switch 220, controls the hydraulic pressure divider valve 217, and the dual vertical adjustment levers connected by a crossbar 210 control the dual pinchroller ram valves 216. Manipulation of the roller speed adjustment lever 230 controls the speed of the pinchrollers and their turning direction. Manipulation of the pinchroller/hydraulic ram pressure divider switch 220 divides hydraulic pressure between the hydraulic rams and the hydraulic motors. Manipulation of the dual vertical adjustment levers 210 by means of the connecting crossbar raises and lowers the shafts of the pinchroller hydraulic rams. By twisting the connecting crossbar, the pinchroller hydraulic rams may be activated at different rates, providing a means of leveling the upper pinchrollers.

Referring to FIG. 4, the upper and lower pinchrollers 170 and 190 comprise a series of modular pinchroller segments 171 and 191. Referring to FIG. 3, the radius rollers 195 mounted behind the pinchrollers are similarly composed of modular segments 196. In operations upon metal workpieces having symmetric upper and lower cross-sectional profiles, the configurations of the radius roller and the upper and lower pinchrollers are identical. The sections of the pinchrollers and the radius roller are easily reconfigured and interchanged by removing the shaft retainer nuts 192 at the end of each of the shafts, by removing the bearing supports 20, by slidably removing pinchrollers and radius roller segments, by slidably installing new pinchroller and radius roller segments having a different configuration over each shaft, and by reinstalling the bearing supports and shaft retainer nuts. The segments of the pinchrollers and the radius roller are preferably composed of solid chrome/molybdenum steel having a high resistance to denting and deformation.

Referring to FIG. 2, the upper and lower pinchrollers 170 and 190 are counter rotated with respect to each other by means of an upper hydraulic motor 160 and a lower hydraulic motor 180. The upper and lower hydraulic motors are respectively mounted upon the pinchroller support beam 150 and upon the pinchroller table 10 by means of hydraulic motor supports 151. The upper and lower hydraulic motors 160 and 180 provide counter-rotating turning forces to the upper and lower pinchroller drive shafts 161 and 162, which in turn rotate the upper and lower pinchroller 170 and 190. Referring to FIG. 5, the radius roller axle 163 and the upper and lower pinchroller drive shafts 161 each have a key channel 164 extending along the axial lengths thereof. The key channels 164 upon application of turning forces to the shafts transfer turning forces to the rollers, causing the rollers to rotate with the shafts. A third hydraulic motor may be similarly attached to an end of the radius roller axle causing the radius rollers to rotate in the same direction as the lower pinchrollers, providing additional force for driving a metal workpiece through the pinch points and over the radius roller.

FIG. 4 provides an example of a configuration of the segmented pinchrollers which might be used by a metal working machine shop having a need for bending sheet metal, two sizes of square tubing and one size of round tubing. By removing the shaft retaining nuts 192 and the bearing supports 20, pinchroller segments having annular ridges thereon closely fitted to the dimensions of the metal workpieces are slidably installed over the upper and lower pinchroller drive shafts 161 and 162. Radius roller segments having an identical configuration are similarly installed over the radius roller axle.

FIG. 5 represents the metal bending machine in operation upon square metal tubing 2. To facilitate bending of square metal tubing, the pinchroller segments 171 and 191 and the radius roller segment 196 each have an annular channel closely fitted to overlie one-quarter of the cross-sectional profile of the square metal workpiece 2. By stacking the pinchroller segments and radius roller segments in this manner, a pinch point approximating the cross-sectional shape of the metal workpiece is formed between the pinchrollers, and a rolling cradle closely fitted for guiding the metal workpiece is formed in the radius roller.

Referring to FIG. 1, to begin the metal bending operation, the "on" button of the electric motor switch box 250 is pressed, referring to FIG. 3, electrically energizing the electric motor 211 and resulting in hydraulic pressure in the hydraulic lines 70 induced by the hydraulic motor 213. Referring again to FIG. 1, the pinchroller/hydraulic ram pressure divider switch 220 is then adjusted to assure that sufficient hydraulic pressure is directed to the pinchroller hydraulic rams 120. Then, the ram adjustment levers 210 are pulled upward causing the shafts of the pinchroller hydraulic rams 121 retract and causing the upper pinchroller 170 to raise. With the upper pinchrollers in a raised position, a metal workpiece such as square metal tubing may be positioned so as to lie over the radius roller and over the lower pinchroller, within the fitted channels within said rollers. With the metal workpiece in such a position, the ram adjustment lever 210 is pressed downward causing the shafts of the pinchroller hydraulic rams 120 to extend, and causing the upper pinchroller to come into compressive contact with the metal workpiece, bending the metal workpiece. The compressive contact of the upper pinchroller upon the metal workpiece occurs within a channel closely fitted to the workpiece. The compressive force of the upper pinchroller pressing down upon the metal workpiece lying in the channels of the lower pinchroller and the radius roller causes the metal workpiece to bend. The roller speed adjustment lever may then be pulled upward, actuating the upper and lower hydraulic motors 160 and 180 causing the upper and lower pinchrollers 170 and 190 to counter-rotate with respect to each other, frictionally driving the metal workpiece through the pinch point between the upper and lower pinchrollers, and toward and over the radius roller, causing the metal workpiece to be progressively bent as it is driven forward through the pinch point. The fitted channels of the upper and lower pinch point allows sufficient compressive force to be applied to the metal workpiece to drive the metal workpiece forward over the radius roller, without crushing or distorting the metal workpiece. The fitted channel of the radius roller prevents the metal workpiece from drifting laterally, preventing spiral bending.

Upon completion of the desired bend in the metal workpiece, the metal workpiece may be removed either by completely driving the metal workpiece through the pinch point, or by pulling upward on the ram adjustment lever 210 causing the upper pinchroller to raise, or by pressing downward on the roller speed adjustment lever 230 causing the upper and lower hydraulic motors 160 and 180 to reverse rotation, driving the metal workpiece out of the pinch point toward the operator.

Referring simultaneously to FIGS. 3 and 5, where lighter metal workpieces are to be bent, or where only a slight bend is to be induced upon a heavier metal workpiece, the positions of the upper and lower pinchrollers 170 and 190 and of the radius roller 195 may be adjusted to allow for successively bending several metal workpieces without intermittently raising and lowering the upper pinchroller.

Where such operation is desirable, referring to FIG. 2, the appropriate pinchroller segments matching the cross-sectional profile of the metal workpiece are slidably mounted upon the upper and lower pinchroller drive shafts 161 and 162. Referring to FIG. 3, similar segments are slidably mounted upon the radius roller axle. Upon configuring the upper and lower pinchrollers and the radius roller to receive the metal workpiece, referring to FIG. 2, the upper pinchroller is fixedly positioned above the lower pinchroller by means of adjustment of the vertical adjustment wheel 100, and adjustment of the pinchroller hydraulic rams 120, so that a pinch point aperture closely fitted to the cross-sectional profile of the metal workpiece is formed. Referring to FIG. 5, the elevation of the radius roller is adjusted by manipulation of the thumb wheels 31 so that as a metal workpiece 2 is driven forward through the pinch point, the end of the metal workpiece contacts the surface of the radius roller at an angle slight enough to allow the radius roller to deflect the end of the workpiece upward without the end of the workpiece jamming or digging into the surface of the radius roller. With the upper and lower pinchrollers and the radius roller so configured, bends may be induced in several successive workpieces by, referring to FIG. 1, inserting the end of a metal workpiece into the appropriate pinch point channel, pulling upward on the roller speed adjustment lever 230, causing the pinchrollers to drive the metal workpiece forward through the pinch point and over the radius roller, and by then pressing downward upon the roller speed adjustment lever 230, causing the workpiece to back out of the pinch point. Where several types of metal workpieces having differing cross-sectional profiles are in need of bends having identical radii of curvature, the sections of the upper and lower pinchrollers and of the radius roller may be configured to receive several different workpieces, and the process of driving metal workpieces into the appropriate pinch point and then backing the workpiece out of the pinch point may be applied successively to several differing workpieces.

In utilization of the metal bending machine, there is no requirement that the upper cross-sectional profile of the metal workpiece to be bent matches the lower cross-sectional profile. For example, the metal bending machine may be utilized to induce bends upon angle iron, the plane of the bend matching the plane of one of the flat surfaces of the angle iron. In order to facilitate such bending, the segments of the lower pinchroller and of the radius roller are configured to match the lower cross-sectional profile of the angle iron, and the upper pinchroller is configured to match the upper cross-sectional profile of the angle iron.

Figure 13:
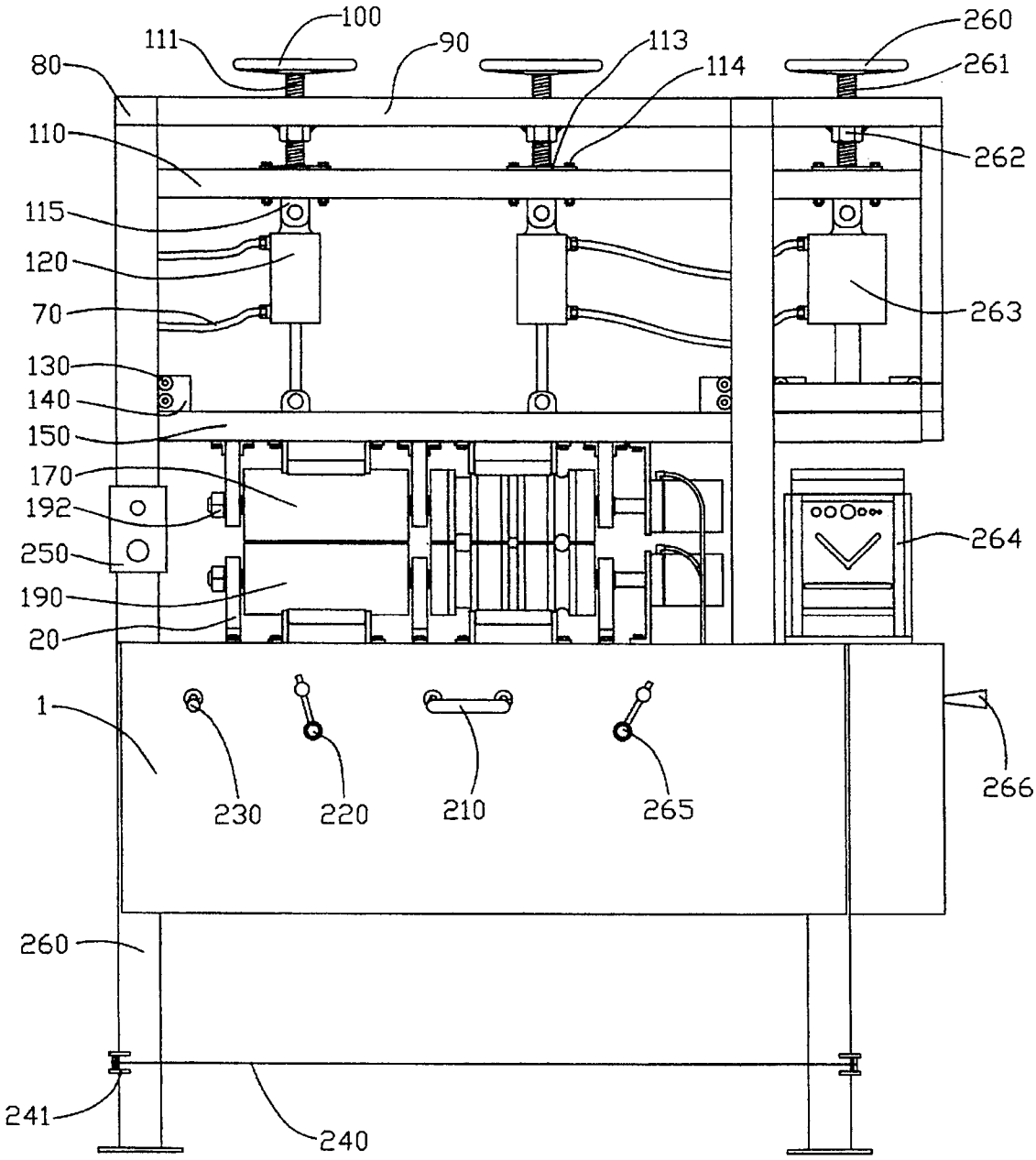
FIG. 13 is an alternate frontal view of the metal bending machine further comprising a shearing and bending press.

Referring to FIG. 13, in an alternate configuration, the metal bending machine further comprises a punching, shearing, and bending press, having a press adjustment wheel 260, a press adjustment screw 261, a press adjustment nut 262, and a press hydraulic ram 263, all mounted and configured similar to the vertical adjustment wheel 100, ram adjustment screw 111, ram adjustment nut 112, and pinchroller hydraulic ram depicted in FIG. 2. In operation, the press hydraulic ram 263 is actuated, imposing a downward force upon a shearing, punching, or metal creasing implement such as the metal cutting shear 264. Upward and downward actuation of the press hydraulic ram 263 is controlled by a press ram activator level 266. Division of hydraulic pressure between the metal bending portion of the metal bending machine and the press hydraulic ram 263 is controlled by a press ram pressure divider switch 265. The combination of a punching, shearing, and metal creasing press with the pinchroller and radius roller metal bender provides for convenience in metal working allowing a machinist to perform metal bending operations and to perform metal shearing, punching, and creasing operations at a single work station.

Referring to FIG. 2, a potential exists for the hands of a machinist operating the metal bending machine to become lodged between the upper and the lower pinchrollers. Upon such an occurrence, a means of deactivating progressive rolling of the upper and lower pinchrollers is desirable. A trip string 240 supported by string retaining brackets 241 serves this function. A machinist who is unable to manually turn off the machine may swing an ankle or a foot into the trip string 240, causing the trip string to open an electrical circuit breaker, stopping the machine.

IN THE CLAIMS

What is claimed is:

1. A metal bending machine for bending a plurality of metal workpieces having various lower cross-sectional profiles, and having various upper cross-sectional profiles, the plane of each such cross-sectional profile being perpendicular to the longitudinal axis of the workpiece; which metal bending machine comprises:

A lower pinchroller drive shaft having a channel along its length, the channel extending radially inward from the lower pinchroller drive shaft's exterior radial surface, and the midline of the channel being parallel to the lower pinchroller drive shaft's central radial axis;

A means of fixedly and rotatably mounting the lower pinchroller drive shaft so that its central radial axis remains in a fixed position, and so that the lower pinchroller drive shaft may rotate about its central radial axis;

A plurality of lower pinchroller discs, each lower pinchroller disc having a circular aperture therethrough, the central radial axis of the circular aperture coinciding with the central radial axis of the lower pinchroller disc, the diameter of the circular aperture being closely fitted to the diameter of the lower pinchroller drive shaft, the interior radial surface of the circular aperture having a ridge extending radially inward, the midline of the ridge being parallel with the central radial axis of the lower pinchroller disc, and the dimensions of the ridge being fitted to allow the ridge to lie within the channel of the lower pinchroller drive shaft; each lower pinchroller disc being slidably mounted over the lower pinchroller drive shaft so that the lower pinchroller drive shaft passes through the circular apertures of the lower pinchroller discs, so that the ridges within the apertures of the lower pinchroller discs lie within the channel of the lower pinchroller drive shaft, and so that the lower pinchroller discs are stacked in close contact with each other; a plurality of the lower pinchroller discs which are slidably mounted over the lower pinchroller drive shaft having annular channels within their exterior radial surfaces, the radial cross-sectional profiles of each such annular channel being closely fitted to a portion of the lower cross-sectional profile of a workpiece to be bent, so that upon slidable mounting of the lower pinchroller discs over the lower pinchroller drive shaft, a lower pinchroller is formed, the exterior radial surface of the lower pinchroller having annular channels therearound, the radial cross-sectional profiles of the channels being respectively closely fitted to the lower cross-sectional profiles of the workpieces to be bent, at least a pair of adjacent contacting lower pinchroller discs each having an annular channel to define one channel for reception of a lower cross sectional profile of a metal workpiece;

An upper pinchroller drive shaft having a channel along its length, the channel extending radially inward from the exterior radial surface of the upper pinchroller drive shaft, and the midline of the channel being parallel to the central radial axis of the upper pinchroller drive shaft;

A means of vertically adjustably and rotatably mounting the upper pinchroller drive shaft so that it may rotate about its axis, and so that it may travel from a first position wherein it lies above and in close proximity with the lower pinchroller, and wherein it is in alignment with the lower pinchroller, to a second position wherein the upper pinchroller drive shaft is substantially vertically above the first position;

A plurality of upper pinchroller discs, each upper pinchroller disc having a circular aperture therethrough, the central radial axis of the circular aperture coinciding with the central radial axis of the upper pinchroller disc, the diameter of the circular aperture being closely fitted to the diameter of the upper pinchroller drive shaft, the interior radial surface of the circular aperture having a ridge extending radially inward, the midline of the ridge being parallel with the central radial axis of the upper pinchroller disc, and the dimensions of the ridge being fitted to lie within the channel of the upper pinchroller drive shaft; each upper pinchroller disc being slidably mounted over the upper pinchroller drive shaft so that the upper pinchroller drive shaft passes through the circular apertures of the upper pinchroller discs so that the ridges within the apertures of the upper pinchroller discs lie within the channel of the upper pinchroller drive shaft, and so that the upper pinchroller discs are stacked in close contact with each other; a plurality of the upper pinchroller discs which are slidably mounted over the upper pinchroller drive shaft having annular channels within their exterior radial surfaces, the radial cross-sectional profile of each such annular channel being closely fitted to a portion of the upper cross-sectional profile of a workpiece to be bent, so that upon slidable mounting and stacking of the upper pinchroller discs over the upper pinchroller drive shaft an upper pinchroller is formed, the exterior radial surface of the upper pinchroller having annular channels therearound, the radial cross-sectional profiles of the channels being respectively closely fitted to the upper cross-sectional profiles of the workpieces to be bent, at least a pair of adjacent contacting upper pinchroller discs each having an annular channel to define one channel for reception of an upper cross sectional profile of a metal workpiece, each such annular channel being positioned upon the upper pinchroller to overlie the corresponding channel within and around the lower pinchroller, and so that when the upper pinchroller drive shaft is in the first position, the upper and lower pinchrollers form pinch points respectively closely fitted to the upper and lower cross-sectional profiles of the workpieces to be bent;

A means of counter-rotating the upper and lower pinchroller drive shafts and the upper and lower pinchrollers with respect to each other so that, when the upper pinchroller drive shaft is in the first position, and when a metal workpiece is inserted into a pinch point fitted to the workpieces' upper and lower cross-sectional profiles, the workpiece is forcefully driven forward through the pinch point from the front side of the upper and lower pinchrollers to the back side of the upper and lower pinchrollers along a line which is substantially tangent to the lower surface of the upper pinchroller, and to the upper surface of the lower pinchroller;

A radius roller axle;

A means of vertically adjustably mounting the radius roller axle so that the radius roller axle may be positioned at various vertical heights with respect to the back side of the pinch points formed by the upper and lower pinchrollers, the central radial axis of the radius roller axle being substantially parallel to the radial axes of the upper and lower pinchrollers; and, A plurality of radius roller discs, each having a circular aperture therethrough, the central radial axis of the circular aperture coinciding with the central radial axis of the radius roller disc, and the diameter of the circular aperture being closely fitted to the diameter of the radius roller disc; each radius roller disc being slidably mounted over the radius roller axle so that the radius roller axle passes through the circular apertures of the radius roller discs, and so that the radius roller discs are stacked in close contact with each other; a plurality of the radius roller discs which are slidably mounted over the radius roller axle having annular channels within their exterior radial surfaces, the radial cross-sectional profile of each such annular channel being closely fitted to a portion of the lower cross-sectional profile of a workpiece to be bent, so that upon slidable mounting of the radius roller discs over the radius roller axle, a radius roller is formed, the exterior radial surface of the radius roller having annular channels therearound, at least a pair of adjacent contacting radius roller discs each having an annular channel to define one channel for reception of a lower cross sectional profile of a metal workpiece, the channels being positioned upon the radius roller so that the planes containing the central circumferences of the channels of the lower pinchroller also contain the central circumferences of the corresponding channels of the radius roller, the channels of the radius roller being fitted to match the corresponding channels of the lower pinchroller, and so that when the upper pinchroller drive shaft is in the first position, when the radius roller axle is vertically positioned so that the upper surface of the radius roller is situated at an elevation higher than the upper surface of the lower pinchroller, when the upper and lower pinchrollers are counter-rotated by the counter-rotating means, and when a metal workpiece is driven forward through a pinch point formed by the upper and lower pinchrollers, the forward end of the metal workpiece may come into contact with the radius roller within a channel having a radial cross-sectional profile closely fitted to the lower cross-sectional profile of the workpiece, and upon such contact, and upon continuation of such forward driving of the metal workpiece, upward deflection of and progressive bending of the metal workpiece occurs.

2. The apparatus of claim No. 1 wherein the radius roller axle has a channel along the length thereof extending radially inward, the midline of the channel being parallel to the central radial axis of the radius roller axle, wherein the aperture through each radius roller disc has a ridge along its interior radial surface extending radially inward, the midline of the ridge being parallel to the central radial axis of the aperture, wherein the ridge is fitted to enable it to lie within the channel within the radius roller axle, wherein the radius roller discs are mounted over the radius roller axle with the ridges of the discs lying within the channel of the axle; and further comprising a means of rotating the radius roller axle and the radius roller in the same direction of rotation as the lower pinchroller, such rotation serving to impart a frictional pulling force upon a metal workpiece passing over the upper surface of the radius roller.

3. The apparatus of claim No. 2 wherein the means of rotating the radius roller axle and the radius roller is a hydraulic motor, the drive shaft of the hydraulic motor being fixedly attached to an end of the radius roller axle.

4. A metal bending machine for bending a plurality of metal workpieces having various lower cross-sectional profiles, and having various upper cross-sectional profiles, the plane of each such cross-sectional profile being perpendicular to the longitudinal axis of the workpiece; which metal bending machine comprises:

A lower pinchroller drive shaft having a channel along its length, the channel extending radially inward from the lower pinchroller drive shaft's exterior radial surface, and the midline of the channel being parallel to the lower pinchroller drive shaft's central radial axis;

A means of fixedly and rotatably mounting the lower pinchroller drive shaft so that its central radial axis remains in a fixed position, and so that the lower pinchroller drive shaft may rotate about its central radial axis, wherein said means comprises a plurality of lower pinchroller bearing supports, each lower pinchroller bearing support being fixedly attached to a pinch roller table, each lower pinchroller bearing support having an aperture therethrough, each such aperture containing and retaining a lower pinchroller bearing, the interior diameter of each lower pinchroller bearing being closely fitted to the diameter of the lower pinchroller drive shaft, the lower pinchroller bearing supports being positioned and aligned upon the pinchroller cable so that the central radial axes of the lower pinchroller bearings coincide with the central radial axis of the lower pinchroller drive shaft, the lower pinchroller drive shaft being rotatably mounted within and through the lower pinchroller bearings;

A plurality of lower pinchroller discs, each lower pinchroller disc having a circular aperture therethrough, the central radial axis of the circular aperture coinciding with the central radial axis of the lower pinchroller disc, the diameter of the circular aperture being closely fitted to the diameter of the lower pinchroller drive shaft, the interior radial surface of the circular aperture having a ridge extending radially inward, the midline of the ridge being parallel with the central radial axis of the lower pinchroller disc, and the dimensions of the ridge being fitted to allow the ridge to lie within the channel of the lower pinchroller drive shaft; each lower pinchroller disc being slidably mounted over the lower pinchroller drive shaft so that the lower pinchroller drive shaft passes through the circular apertures of the lower pinchroller discs, so that the ridges within the apertures of the lower pinchroller discs lie within the channel of the lower pinchroller drive shaft, and so that the lower pinchroller discs are stacked in close contact with each other; a plurality of the lower pinchroller discs which are slidably mounted over the lower pinchroller drive shaft having annular channels within their exterior radial surfaces, the radial cross-sectional profiles of each such annular channel being closely fitted to a portion of the lower cross-sectional profile of a workpiece to be bent, so that upon slidable mounting of the lower pinchroller discs over the lower pinchroller drive shaft, a lower pinchroller is formed, the exterior radial surface of the lower pinchroller having annular channels therearound, the radial cross-sectional profiles of the channels being respectively closely fitted to the lower cross-sectional profiles of the workpieces to be bent;

An upper pinchroller drive shaft having a channel along its length, the channel extending radially inward from the exterior radial surface of the upper pinchroller drive shaft, and the midline of the channel being parallel to the central radial axis of the upper pinchroller drive shaft;

A means of vertically adjustably and rotatably mounting the upper pinchroller drive shaft so that it may rotate about its axis, and so that it may travel from a first position wherein it lies above and in close proximity with the lower pinchroller, and wherein it is in alignment with the lower pinchroller, to a second position wherein the upper pinchroller drive shaft is substantially vertically above the first position, wherein said means comprises a plurality of support columns fixedly attached to and extending vertically upward from the pinchroller table; a fixed crossbeam fixedly attached to and interconnecting the upper ends of the support columns, the fixed crossbeam being positioned to overlie the lower pinchroller, the longitudinal axis of the fixed crossbeam being substantially parallel with the central radial axis of the lower pinchroller, the fixed crossbeam having a first aperture extending vertically therethrough and a second aperture extending vertically therethrough, the first aperture being positioned to overlie the left end of the lower pinchroller, and the second aperture being positioned to overlie the right end of the lower pinchroller; a first threaded nut being fixedly attached to the lower surface of the fixed crossbeam and positioned so that the bore of the first threaded nut is aligned with the first aperture; a second threaded nut being fixedly attached to the lower surface of the fixed crossbeam and positioned so that its threaded bore is aligned with the second aperture; the first threaded nut having rotatably mounted therethrough a first threaded shaft; the second threaded nut having rotatably mounted therethrough a second threaded shaft, the upper ends of the first and second threaded shafts extending above the upper surface of the fixed crossbeam, each such upper end having a turnwheel fixedly attached thereto, and the lower ends of the first and second threaded shafts extending below the lower surfaces of the first and second threaded nuts; a ram support crossbeam pivotally attached to and interconnecting the lower ends of the first and second threaded shafts, the left and right ends of the ram support crossbeam being slidably guided and supported by left and right vertical adjustment track braces, the left and right vertical adjustment track braces being fixedly attached to the lower surface of the fixed crossbeam and extending vertically downward therefrom; a left and a right hydraulic ram, the left and right hydraulic rams being pivotally attached to the lower surface of the ram support crossbeam, the left hydraulic ram being positioned so as to overlie the left end of the lower pinchroller and the right hydraulic ram being positioned to overlie the right end of the lower pinchroller; the left and the right hydraulic rams each having a hydraulic ram shaft extending vertically downward therefrom; a pinchroller support crossbeam pivotally attached to and interconnecting the lower ends of the hydraulic ram shafts of the left and right hydraulic rams, the left and right ends of the pinchroller support crossbeam being slidably guided and supported by the left and right vertical adjustment tracks; and a plurality of upper pinchroller bearing supports, each upper pinchroller bearing support being fixedly attached to the lower surface of the pinchroller support crossbeam, each upper pinchroller bearing support having an aperture therethrough, each aperture containing an upper pinchroller bearing whose interior diameter is closely fitted to the diameter of the upper pinchroller drive shaft; the upper pinchroller drive shaft being rotatably mounted within and through the upper pinchroller bearings, manual rotation of the first and the second threaded shafts in combination with hydraulic actuation of the left and right hydraulic rams allowing the position of the upper pinchroller with respect to the lower pinchroller to be multiply adjustable;

A plurality of upper pinchroller discs, each upper pinchroller disc having a circular aperture therethrough, the central radial axis of the circular aperture coinciding with the central radial axis of the upper pinchroller disc, the diameter of the circular aperture being closely fitted to the diameter of the upper pinchroller drive shaft, the interior radial surface of the circular aperture having a ridge extending radially inward, the midline of the ridge being parallel with the central radial axis of the upper pinchroller disc, and the dimensions of the ridge being fitted to lie within the channel of the upper pinchroller drive shaft; each upper pinchroller disc being slidably mounted over the upper pinchroller drive shaft so that the upper pinchroller drive shaft passes through the circular apertures of the upper pinchroller discs so that the ridges within the apertures of the upper pinchroller discs lie within the channel of the upper pinchroller drive shaft, and so that the upper pinchroller discs are stacked in close contact with each other; a plurality of the upper pinchroller discs which are slidably mounted over the upper pinchroller drive shaft having annular channels within their exterior radial surfaces, the radial cross-sectional profile of each such annular channel being closely fitted to a portion of the upper cross-sectional profile of a workpiece to be bent, so that upon slidable mounting and stacking of the upper pinchroller discs over the upper pinchroller drive shaft an upper pinchroller is formed, the exterior radial surface of the upper pinchroller having annular channels therearound, the radial cross-sectional profiles of the channels being respectively closely fitted to the upper cross-sectional profiles of the workpieces to be bent, each such annular channel being positioned upon the upper pinchroller to overlie the corresponding channel within and around the lower pinchroller, and so that when the upper pinchroller drive shaft is in the first position, the upper and lower pinchrollers form pinch points respectively closely fitted to the upper and lower cross-sectional profiles of the workpieces to be bent;

A means of counter-rotating the upper and lower pinchroller drive shafts and the upper and lower pinchrollers with respect to each other so that, when the upper pinchroller drive shaft is in the first position, and when a metal workpiece is inserted into a pinch point fitted to the workpieces' upper and lower cross-sectional profiles, the workpiece is forcefully driven forward through the pinch point from the front side of the upper and lower pinchrollers to the back side of the upper and lower pinchrollers along a line which is substantially tangent to the lower surface of the upper pinchroller, and to the upper surface of the lower pinchroller, wherein said means comprises an upper hydraulic motor and a lower hydraulic motor, the drive shaft of the upper hydraulic motor being fixedly attached to an end of the upper hydraulic motor drive shaft, and the drive shaft of the lower hydraulic motor being fixedly attached to an end of the lower pinchroller drive shaft;

A radius roller axle;

A means of vertically adjustably mounting the radius roller axle so that the radius roller axle may be positioned at various vertical heights with respect to the back side of the pinch points formed by the upper and lower pinchrollers, the central radial axis of the radius roller axle being substantially parallel to the radial axes of the upper and lower pinchrollers, wherein said means comprises a plurality of radius roller bearing supports, each radius roller support being fixedly attached to the pinchroller table, each radius roller bearing support having a threaded radius roller adjustment shaft rotatably and slidably mounted within a channel within the radius roller bearing support and through a threaded thumb wheel, the thumb wheel being rotatably mounted within the radius roller bearing support, the channel being aligned within the radius roller bearing support so that rotation of the thumb wheel may alternately raise and lower the radius roller adjustment shaft, the upper end of each radius roller adjustment shaft having a semi-circular radius roller bearing cradle fixedly attached thereto, each radius roller bearing cradle containing and retaining a radius roller bearing whose interior diameter is closely fitted to the diameter of the radius roller axle, the radius roller axle being rotatably mounted within and through the radius roller bearings, the vertical position of the radius roller being adjustable through manual rotation of the thumb wheels mounted within the radius roller bearing supports, causing the radius roller adjustment shafts to be raised or lowered, raising or lowering the radius roller;

A plurality of radius roller discs, each having a circular aperture therethrough, the central radial axis of the circular aperture coinciding with the central radial axis of the radius roller disc, and the diameter of the circular aperture being closely fitted to the diameter of the radius roller disc; each radius roller disc being slidably mounted over the radius roller axle so that the radius roller axle passes through the circular apertures of the radius roller discs, and so that the radius roller discs are stacked in close contact with each other; a plurality of the radius roller discs which are slidably mounted over the radius roller axle having annular channels within their exterior radial surfaces, the radial cross-sectional profile of each such annular channel being closely fitted to a portion of the lower cross-sectional profile of a workpiece to be bent, so that upon slidable mounting of the radius roller discs over the radius roller axle, a radius roller is formed, the exterior radial surface of the radius roller having annular channels therearound, the channels being positioned upon the radius roller so that the planes containing the central circumferences of the channels of the lower pinchroller also contain the central circumferences of the corresponding channels of the radius roller, the channels of the radius roller being fitted to match the corresponding channels of the lower pinchroller, and so that when the upper pinchroller drive shaft is in the first position, when the radius roller axle is vertically positioned so that the upper surface of the radius roller is situated at an elevation higher than the upper surface of the lower pinchroller, when the upper and lower pinchrollers are counter-rotated by the counter-rotating means, and when a metal workpiece is driven forward through a pinch point formed by the upper and lower pinchrollers, the forward end of the metal workpiece may come into contact with the radius roller within a channel having a radial cross-sectional profile closely fitted to the lower cross-sectional profile of the workpiece, and upon such contact, and upon continuation of such forward driving of the metal workpiece, upward deflection of and progressive bending of the metal workpiece occurs.

5. The apparatus of claim No. 2 further comprising a hydraulic pump fixedly mounted beneath the pinch roller table; an electric motor fixedly mounted beneath the pinch roller table, the drive shaft of the electric motor being fixedly attached to the drive shaft of the hydraulic pump; a hydraulic oil reservoir fixedly mounted beneath the pinch roller table; a hydraulic tube connecting the hydraulic oil reservoir to the intake port of the hydraulic pump; a first network of hydraulic tubes connecting the hydraulic output port of the hydraulic pump to the left and right hydraulic rams and to the upper and lower hydraulic motors, the first network of hydraulic tubes passing through a series of lever controlled hydraulic valves for controlling the rate of flow and pressure of hydraulic oil from the hydraulic pump to the left and right hydraulic rams and to the upper and lower hydraulic motors; and a second network of hydraulic tubes extending from the hydraulic motors to the hydraulic oil reservoir for return flow of hydraulic oil.

6. The apparatus of claim No. 2 wherein each of the upper pinchroller bearings and wherein each of the lower pinchroller bearings is a self-aligning spherical bearing.

7. The apparatus of claim No. 2 further comprising a plurality of lower pinchroller deflection bearings, and a plurality of upper pinchroller deflection bearings, the lower pinchroller deflection bearings being fixedly and rotatably mounted on the pinchroller table so that the exterior radial surfaces of the lower pinchroller deflection bearings are aligned with and roll along the exterior radial surface of the lower pinchrollers, and the upper pinchroller deflection bearings being fixedly and rotatably mounted upon the lower surface of the pinchroller support beam so that the exterior radial surfaces of the upper pinch roller deflection bearings are in contact with and roll along the exterior radial surface of the upper pinchroller, the upper and lower pinchroller deflection bearings reducing deflection and bending of the upper and lower pinchrollers upon application of force to such rollers by the left and right hydraulic rams.

8. The apparatus of claim No. 2 wherein the radius roller and the upper and lower pinchrollers are composed of chrome/molybdenum steel.

9. The apparatus of claim No. 2 further comprising a hydraulically actuated metal bending and shearing press fixedly attached to the outer lateral surface of the support columns, the metal bending and shearing press allowing metal workpieces bent or to be bent through the action of the upper and lower pinchrollers and radius roller to be conveniently punched, shorn, notched, or creased.

* * * * *